US006758420B2

(12) United States Patent
Arioka et al.

(10) Patent No.: US 6,758,420 B2
(45) Date of Patent: Jul. 6, 2004

(54) FUEL INJECTION VALVE

(75) Inventors: Akira Arioka, Miyagi (JP); Koji Kitamura, Miyagi (JP)

(73) Assignee: Keihin Corporation, Tokyo (JP)

( * ) Notice: Subject to any disclaimer, the term of this patent is extended or adjusted under 35 U.S.C. 154(b) by 274 days.

(21) Appl. No.: 09/983,221

(22) Filed: Oct. 23, 2001

(65) Prior Publication Data

US 2002/0063174 A1 May 30, 2002

(30) Foreign Application Priority Data

Oct. 24, 2000 (JP) ..... 2000-329778

(51) Int. Cl.[7] ..... B05B 1/30

(52) U.S. Cl. ..... 239/585.4; 239/533.12; 239/552; 239/585.1; 239/596; 239/601

(58) Field of Search ..... 239/533.12, 552, 239/584, 585.1, 585.4, 596, 601, 900

(56) References Cited

U.S. PATENT DOCUMENTS 5,449,114 A * 9/1995 Wells et al. ..... 239/596
5,911,366 A * 6/1999 Maier et al. ..... 239/596
6,070,812 A * 6/2000 Tani et al. ..... 239/552
6,161,780 A * 12/2000 Sugimoto et al. ..... 239/533.12
6,405,946 B1 * 6/2002 Harata et al. ..... 239/596
6,616,071 B2 * 9/2003 Kitamura et al. ..... 239/585.1

FOREIGN PATENT DOCUMENTS

JP 11-70347 3/1999

* cited by examiner

*Primary Examiner*—Steven J. Ganey
(74) *Attorney, Agent, or Firm*—Arent Fox PLLC

(57) ABSTRACT

A fuel injection valve includes a valve seat member having a valve seat and a valve bore provided through a central portion of the valve seat, and an injector plate coupled to an outer end face of the valve seat member and having a plurality of fuel injection bores arranged in an annular shape surrounding an axis of the valve bore. A fuel diffusion chamber is defined between the valve seat member and the injector plate, and faced by the valve bore and all the fuel injection bores. The plurality of the fuel injection bores are formed in parallel to the axis of the valve bore, and the spreading angle of a fuel spray foam formed by the fuel injected from the fuel injection bores is determined depending on an axis distance between the valve bore and each of the fuel injection bores. Thus, it is possible to determine the spreading angle of the fuel spray foam as desired.

3 Claims, 7 Drawing Sheets

FUEL INJECTION VALVE

BACKGROUND OF THE INVENTION

1. Field of the Invention

The present invention relates to a solenoid-type fuel injection valve mainly for use in a fuel supply system in an internal combustion engine, and particularly to an improvement of a solenoid-type fuel injection valve comprising a valve seat member having a valve seat and a valve bore provided through a central portion of the valve seat, a valve stem for opening and closing the valve bore by cooperation with the valve seat, an injector plate coupled to an outer end face of the valve seat member and having a plurality of fuel injection bores disposed around an axis of the valve bore, and a fuel diffusion chamber which is defined between the valve seat member and the injector plate and which is faced by the valve bore and all of the fuel injection bores.

2. Description of the Related Art

Such a solenoid-type fuel injection valve is already known, for example, as disclosed in Japanese Patent Application Laid-open No.11-70347.

In such fuel injection valve, the fuel injection bores are provided in the injection plate so that they are inclined to become farther radially from the axis of the valve bore at a more downstream location, and the angle of a fuel spray foam formed by the fuel injected from all the fuel injection bores are determined depending on such inclination angle.

When the fuel injection bores are provided in the injection plate so that they are inclined to become farther radially from the axis of the valve bore at the more downstream location, the directions of inclination of the fuel injection bores are different. For this reason, it is not easy to make the fuel injection bores and hence, it is extremely difficult to provide a spreading angle of a fuel spray foam, as desired.

SUMMARY OF THE INVENTION

Accordingly, it is an object of the present invention to provide a fuel injection valve of the above-described type, wherein the spreading angle of the fuel spray foam can be determined as desired, while facilitating the formation of the fuel injection bores.

To achieve the above object, according to a first aspect and feature of the present invention, there is provided a solenoid-type fuel injection valve comprising a valve seat member having a valve seat and a valve bore provided through a central portion of the valve seat, a valve stem for opening and closing the valve bore by cooperation with the valve seat, an injector plate coupled to an outer end face of the valve seat member and having a plurality of fuel injection bores disposed around an axis of the valve bore, and a fuel diffusion chamber which is defined between the valve seat member and the injector plate and which is faced by the valve bore and all of the fuel injection bores, wherein the plurality of fuel injection bores are formed in parallel to the axis of the valve bore, and the spreading angle of a fuel spray foam formed by the fuel injected from the fuel injection bores is determined depending on an axis distance between the valve bore and each of the fuel injection bores.

With the first feature, the spreading angle of a fuel spray foam formed by the fuel injected from the fuel injection bores is increased with an increase in axis distance between the valve bore and each of the fuel injection bores. This can be utilized to determine the spreading angle of the fuel spray foam as desired by determining only the axis distance between the valve bore and each of the fuel injection bores. Moreover, since the fuel injection bores are formed in parallel to the axis of the valve bore, they can be formed in a multi-axis manner in the injector plate, leading to a substantially enhanced productivity. Therefore, it is possible to provide the spreading angle of the fuel spray foam as desired, while facilitating the formation of the fuel injection bores.

According to a second aspect and feature of the present invention, in addition to the first feature, a relationship between the thickness t of the injector plate and the diameter d of each of the fuel injection bores is set at $t/d<1$.

With the second feature, the atomization of the fuel injected from each of the fuel injection bores can be promoted, while reducing the function of restricting the direction of the fuel injected from each of the fuel injection bores. The setting of the spreading angle of the fuel spray foam depending on the axis distance R between the valve bore and each of the fuel injection bores can be achieved further easily and properly by reducing the function of restricting the direction of the fuel injected from each of the fuel injection bores. Thus, it is possible to achieve the proper setting of the spreading angle of the fuel spray foam and the promotion of the atomization of the injected fuel simultaneously.

According to a third aspect and feature of the present invention, in addition to the first or second feature, each of the fuel injection bores is formed into a frustoconical shape with its diameter increased toward its downstream side.

With the third feature, it is possible to further promote the atomization of the injected fuel.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment of the present invention with reference to the accompanying drawings.

Figure 1:
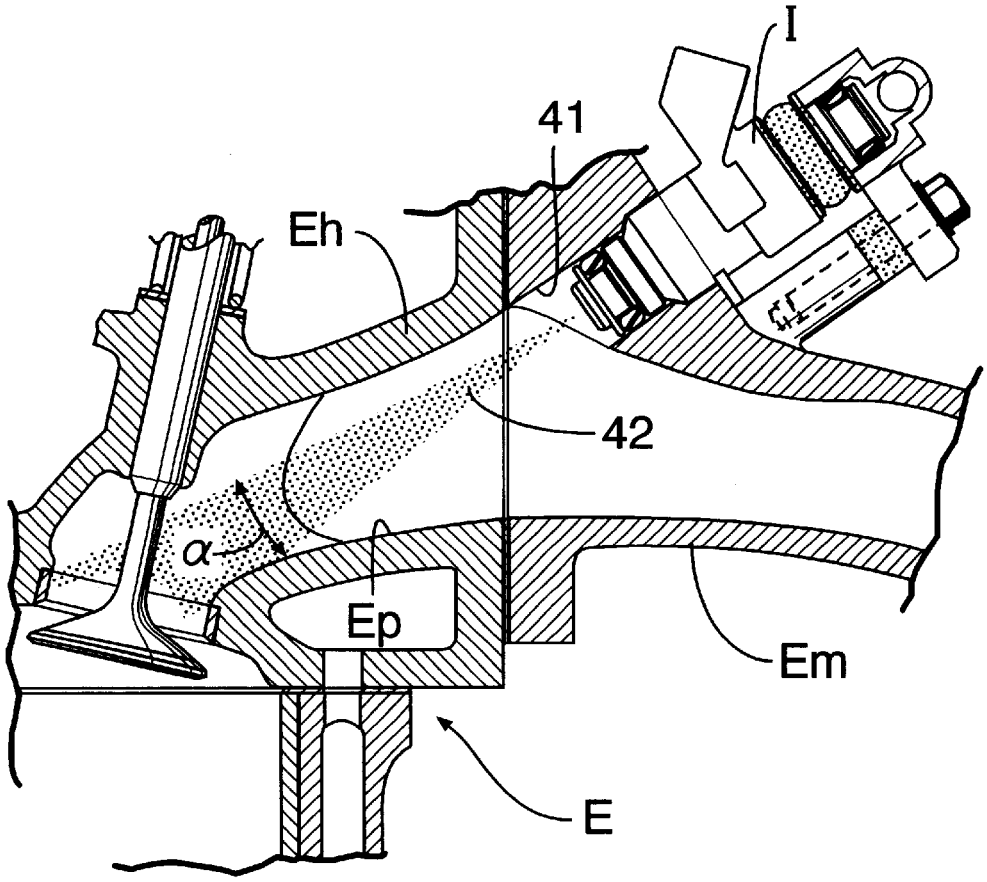
FIG. 1 is a vertical sectional view of an essential portion of an internal combustion engine provided with a solenoid-type fuel injection valve.

Referring first to FIG. 1, a solenoid-type fuel injection valve I according to the present invention is mounted in an intake manifold Em coupled to one side of a cylinder head Eh of an internal combustion engine E, with its fuel injecting portion directed to an outlet of an intake port Ep in the cylinder head Eh.

Figure 2:
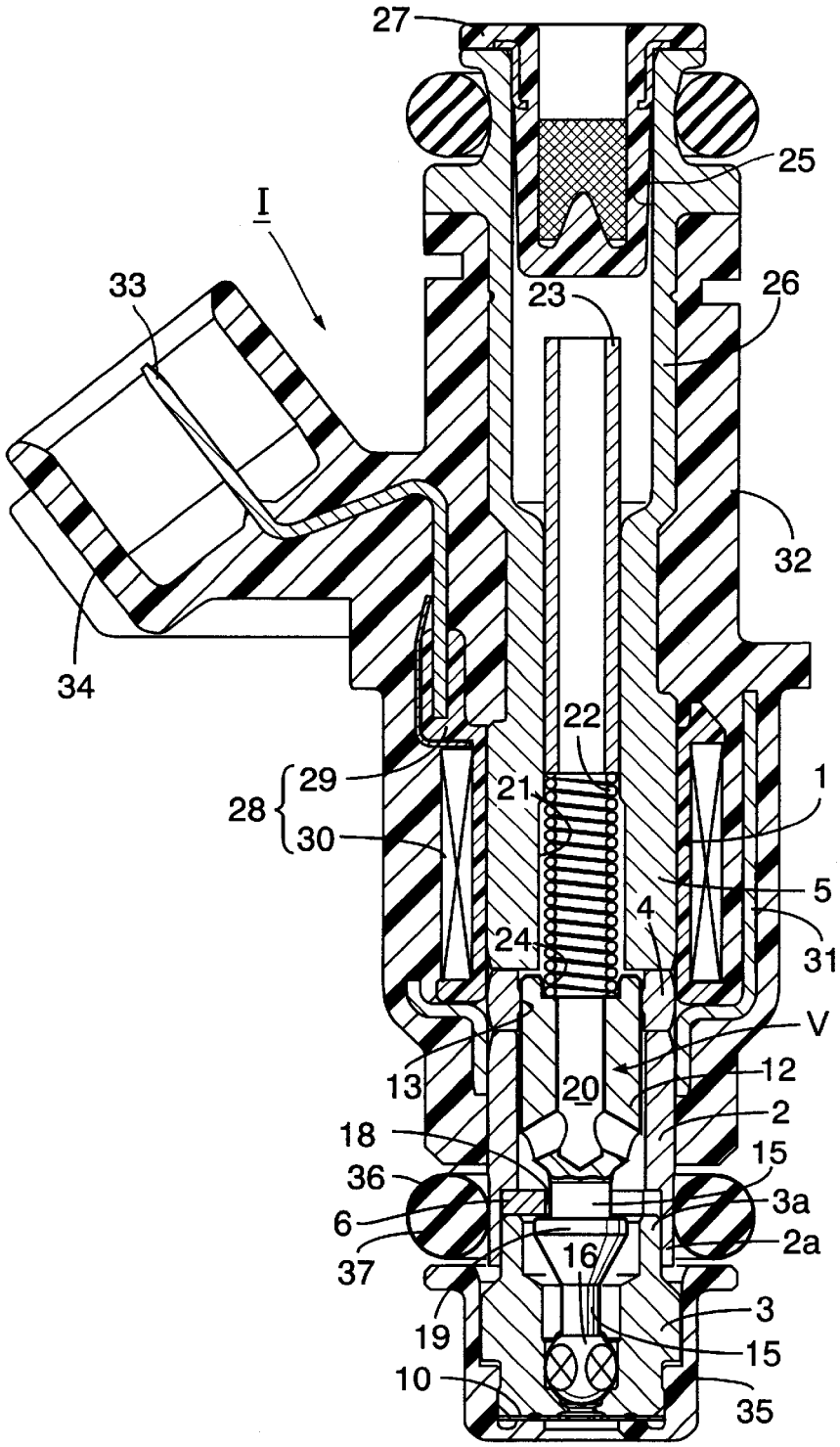
FIG. 2 is a vertical sectional view of the solenoid-type fuel injection valve.
Figure 3:
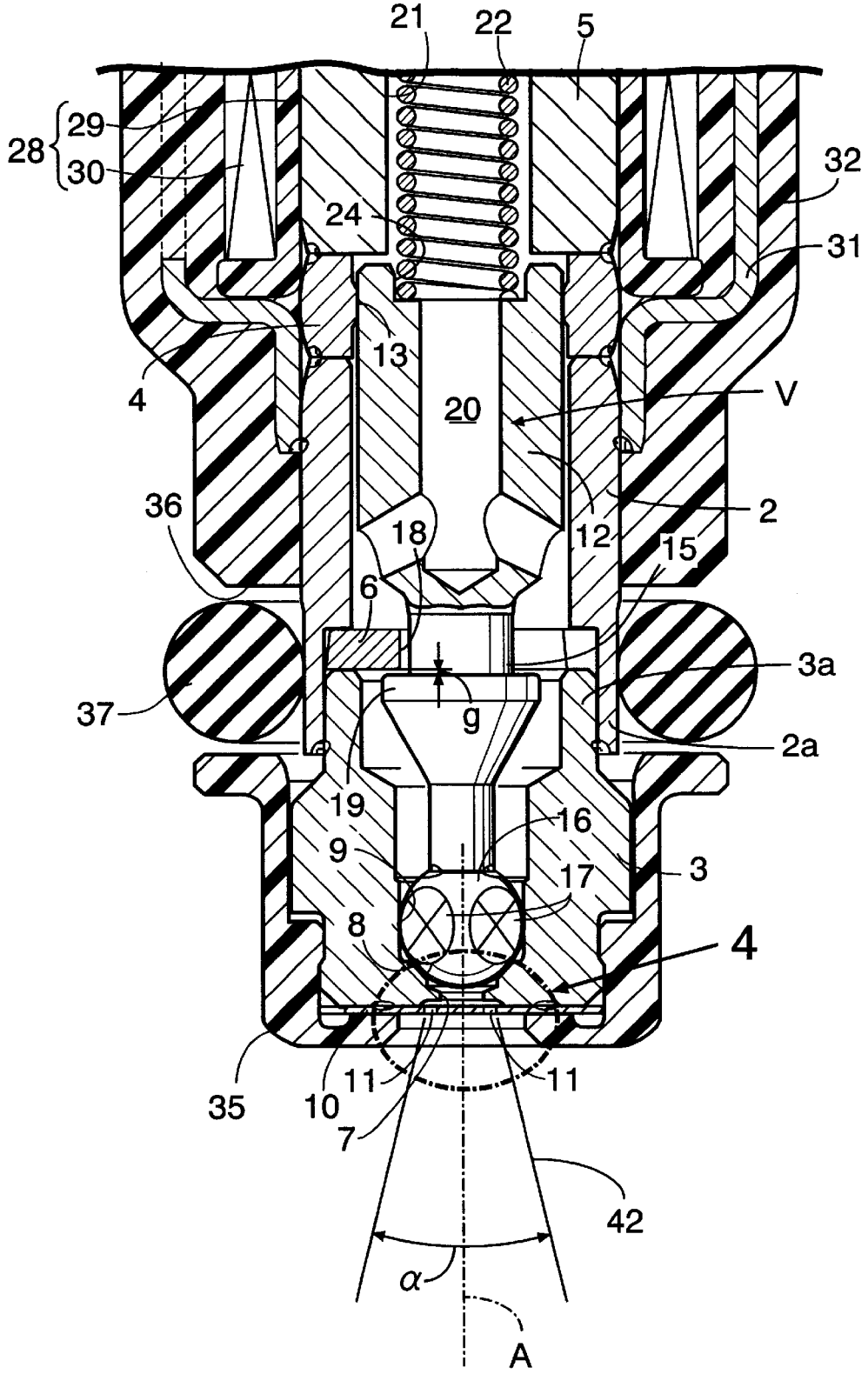
FIG. 3 is an enlarged view of an essential portion shown in FIG. 2.

As shown in FIGS. 2 and 3, a casing 1 of the solenoid-type fuel injection valve I is comprised of a cylindrical valve housing 2 (made of a magnetic material), a bottomed cylindrical valve seat member 3 liquid-tightly coupled to a front end of the valve housing 2, and a cylindrical stationary core 5 liquid-tightly coupled to a rear end of the valve housing 2 with an annular spacer 4 interposed therebetween.

The annular spacer 4 is made of a non-magnetic metal, e.g., a stainless steel, and the valve housing 2 and the stationary core 5 are put against opposite ends of the annular spacer 4 and liquid-tightly welded over the entire periphery thereof to the annular spacer 4.

A first fitting tubular portion 3*a* and a second fitting tubular portion 2*a* are formed at opposed ends of the valve seat member 3 and the valve housing 2, respectively. The first fitting tubular portion 3*a* is press-fitted into the second fitting tubular portion 2*a* along with a stopper plate 6, which is clamped between the valve housing 2 and the valve seat member 3. After fitting of the first and second fitting tubular portions 3*a* and 2*a*, laser beam welding is conducted over the entire periphery of an annular corner exposed from the first fitting portion 2*a* and sandwiched between an outer peripheral surface of the first fitting tubular portion 3*a* and an end face of the second fitting tubular portion 2*a*, whereby the valve housing 2 and the valve seat member 3 are liquid-tightly coupled to each other.

The valve seat member 3 includes a valve bore 7 which opens into a front end face of the valve seat member 3, a conical valve seat 8 connected to an inner end of the valve bore 7, and a cylindrical guide bore 9 connected to a larger-diameter portion of the valve seat 8. The guide bore 9 is formed coaxially with the second fitting tubular portion 2*a*.

Figure 4:
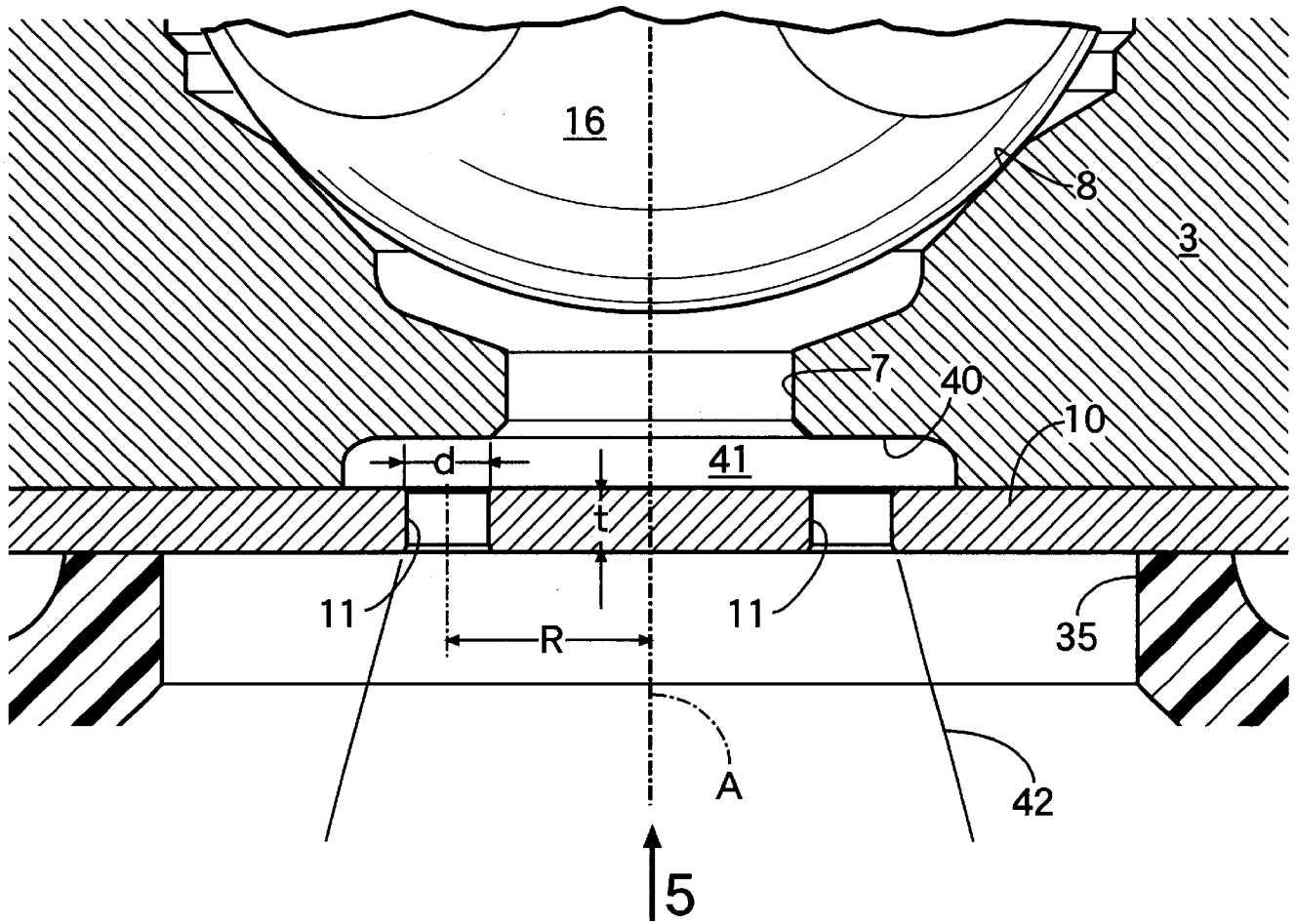
FIG. 4 is an enlarged view of a portion indicated by 4 in FIG. 3.
Figure 5:
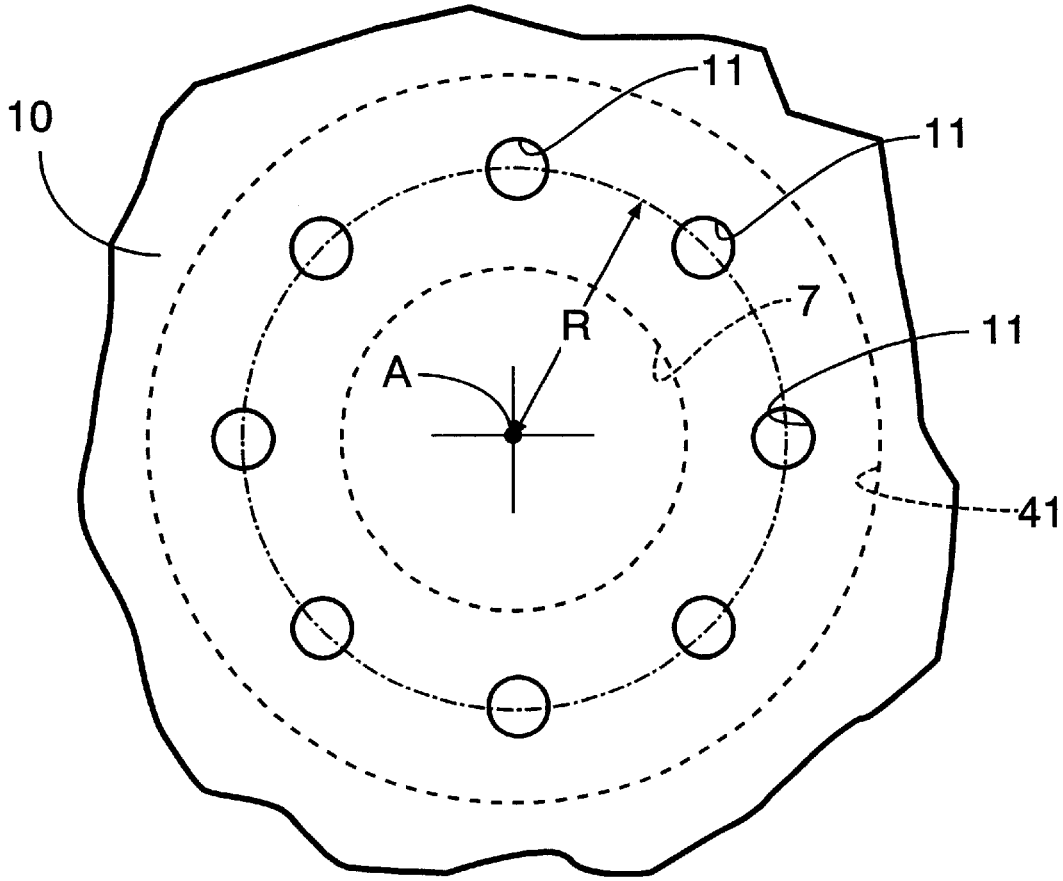
FIG. 5 is an enlarged view taken in a direction of an arrow 5 in FIG. 4.

As shown in FIG. 3 or 4, an injector plate 10 made of a steel plate is liquid-tightly welded over its entire periphery to the front end face of the valve seat member 3. A narrow recess 40 circular about the valve bore 7 is formed in a surface of the valve seat member 3 opposed to the injector plate 10, and constitutes a fuel diffusion chamber 41 between the valve seat member 3 and the injector plate 10. A plurality of, desirably, six to twelve fuel injection bores 11 are provided in the injector plate 10 and open into the fuel diffusion chamber 41. All the fuel injection bores 11 are formed in parallel to an axis A of the valve bore 7 and arranged in an annular shape surrounding the axis A (see FIG. 5). A spreading angle a of a fuel spray foam 42 formed by a fuel flow injected from the fuel injection bores 11 is determined depending on an axis distance R between the valve bore 7 and each of the fuel injection bores 11.

If the diameter of each fuel injection bore 11 is represented by d, and the thickness of the injector plate 10 is represented by t, the thickness t and the diameter d are determined so that a relationship, $t/d<1$ is established.

Referring again to FIG. 2, a movable core 12 opposed to the front end face of the stationary core 5 is accommodated in the valve housing 2 and the annular spacer 4, and an annular guide face 13 is projectingly provided on an inner peripheral surface of the annular spacer 4 for carrying the movable core 12 for sliding movement in an axial direction.

The movable core 12 is integrally provided with a smaller-diameter rod 15 extending from one end face of the movable core 12 toward the valve seat 8, and a spherical valve portion 16 is secured by welding to a tip end of the rod 15 and capable of being seated on the valve seat 8. A valve body V is constituted by the movable core 12, the rod 15 and the valve portion 16.

The valve portion 16 is carried in the guide bore 9 for sliding movement in the axial direction, and a plurality of chamfers 17 are formed in an arrangement at equal distances on an outer peripheral surface of the valve 16 to enable the flowing of the fuel within the guide bore 9.

The stopper plate 6 is provided with a notch 18 through which the rod 15 is passed, and a stopper flange 19 is formed at an intermediate portion of the rod 15 and opposed to an end face of the stopper plate 6 adjacent the valve seat 8. A gap g is provided between the stopper plate 6 and the stopper flange 19 to correspond to an opening stroke of the valve portion 16 provided when the valve portion 16 is closed, i.e., when the valve portion 16 is seated on the valve seat 8.

On the other hand, a gap is provided between the stationary core 5 and the movable core 12. This gap is of a size enough to avoid the abutment of the stationary and movable cores 5 and 12 against each other even when the valve portion 16 is closed, i.e., when the valve portion 16 is seated on the valve seat 8.

The stationary core 5 has a hollow 21 communicating with the inside of the valve housing 2 through a through-bore 20 in the movable core 12. Accommodated in the hollow 21 are a coil valve spring 22 for biasing the movable core 12 in a direction of closing of the valve portion 16, i.e., a direction of seating of the valve portion 16 on the valve seat 8, and a pipe-shaped retainer 23 for supporting a rear end of the valve spring 22.

In this case, a positioning recess 24 for receiving the front end of the valve spring 22 is defined in the rear end face of the movable core 12. The preset load of the valve spring 22 is adjusted by the depth of press-fitting of the retainer 23 into the hollow 21.

An inlet tube 26 is integrally connected to the rear end of the stationary core 5 and has a fuel inlet 25 communicating with the hollow 21 in the stationary core 5 through the pipe-shaped retainer 23, and a fuel filter 27 is mounted in the fuel inlet 25.

A coil assembly 28 is fitted over outer peripheries of the annular spacer 4 and the stationary core 5. The coil assembly 28 comprises a bobbin 29 fitted over the outer peripheries of the annular spacer 4 and the stationary core 5, and a coil 30 wound the bobbin 29. A coil housing 31 surrounding the coil assembly 28 is coupled at one end thereof to the outer peripheral surface of the valve housing 2.

The coil housing 31, the coil assembly 28 and the stationary core 5 are embedded in a sealed manner in a cover 32 made of a synthetic resin. A coupler 34 including a connecting terminal 33 leading to the coil 30 is integrally connected to an intermediate portion of the cover 32.

An annular groove 36 is defined between a front end face of the cover 32 and a cap 35 made of a synthetic resin and fitted over a front end of the valve seat member 3, and an 0-ring 37 is mounted in the annular groove 36 to come into close contact with the outer peripheral surface of the valve housing 2. The 0-ring 37 is adapted to come into close contact with an inner peripheral surface of a mounting bore in the intake manifold Em (see FIG. 1) upon mounting of the solenoid-type fuel injection valve I in the mounting bore.

The operation of the embodiment will be described below.

As shown in FIG. 2, in a state in which the coil 30 has been deexited, the valve body V is urged forwards by a biasing force of the valve spring 22, whereby the valve portion 16 is seated on the valve seat 8. Therefore, a high-pressure fuel supplied from a fuel pump (not shown) through the fuel filter 35 and the inlet tube 26 into the valve housing 1 is put on standby in the valve housing 1.

When the coil 30 is excited by supplying electric current to the coil 30, a magnetic flux produced thereby runs sequentially to the stationary core 5, the coil housing 31, the valve housing 2 and the movable core 12, and the movable core 12 is attracted to the stationary core 5 along with the valve portion 16 by a magnetic force, whereby the valve seat 8 is opened. Therefore, the high-pressure fuel in the valve housing 2 is transferred via the chamfers 17 of the valve portion 16 and through the valve bore 7 into the fuel diffusion chamber 41, where the high-pressure fuel is dispensed to the plurality of fuel injection bores 11, while being diffused to the periphery of the fuel diffusion chamber 41. Then, the fuel is injected toward the outlet of the intake port Ep in the internal combustion engine E, as shown in FIG. 1.

In this case, the spreading angle a of the fuel spray foam 2 formed by the fuel flow injected from the fuel injection bores 11 is determined by the axis distance R between the valve bore 7 and each of the fuel injection bores 11.

Figure 7:
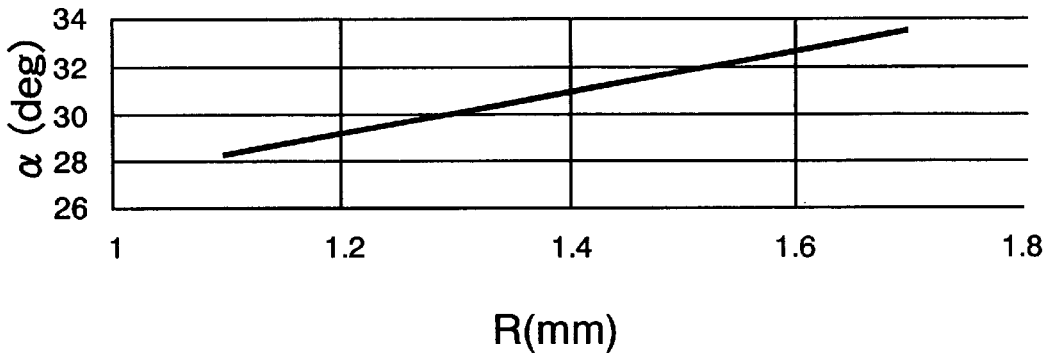
FIG. 7 is a diagram showing the relationship between the axis distance R between a valve bore and each of fuel injection bores and the spreading angle a of a fuel spray foam.

More specifically, although the high-pressure fuel passed from the valve bore 7 into the fuel diffusion chamber 41 is diffused in the chamber 41, the vector of the high-pressure fuel flow passed through each of the fuel injection bores 11 has a radial component and an axial component. Particularly, the radial component is larger as the axis distance R between the valve bore 7 and each of the injection bores 11 is larger. As a result, the spreading angle a of the fuel spray foam 42 formed by the fuel injected from the fuel injection bores 11 is increased with an increase in axis distance R between the valve bore 7 and the injection bore 11, as shown in FIG. 7. This has been confirmed by a test.

Moreover, each of the fuel injection bores 11 is formed in parallel to the axis A of the valve bore 7, i.e., perpendicularly to the injector plate 10 and hence, the fuel injection bores 11 can be formed in a multi-axis manner in the injector plate 10 by pressing or by drilling, leading to a substantially enhanced productivity.

In addition, the thickness t of the injector plate 10 and the minimum diameter d of the fuel injection bores 11 is set in the relationship, $t/d<1$ and hence, the atomization of the fuel injected from each of the fuel injection bores 11 can be promoted, while reducing the function of restricting the direction of the fuel injected from each of the fuel injection bores 11. The reduction of the function of restricting the direction of the fuel injected from each of the fuel injection bores 11 provides an advantage that the spreading angle a of the fuel spray foam 42 can be set properly depending on the axis distance R between the valve bore 7 and each of the fuel injection bores 11.

Thus, the spreading angle of the fuel spray foam 42 can be determined as desired, while facilitating the formation of the fuel injection bores 11 and at the same time, the atomization of the injected fuel can be promoted.

Figure 6:
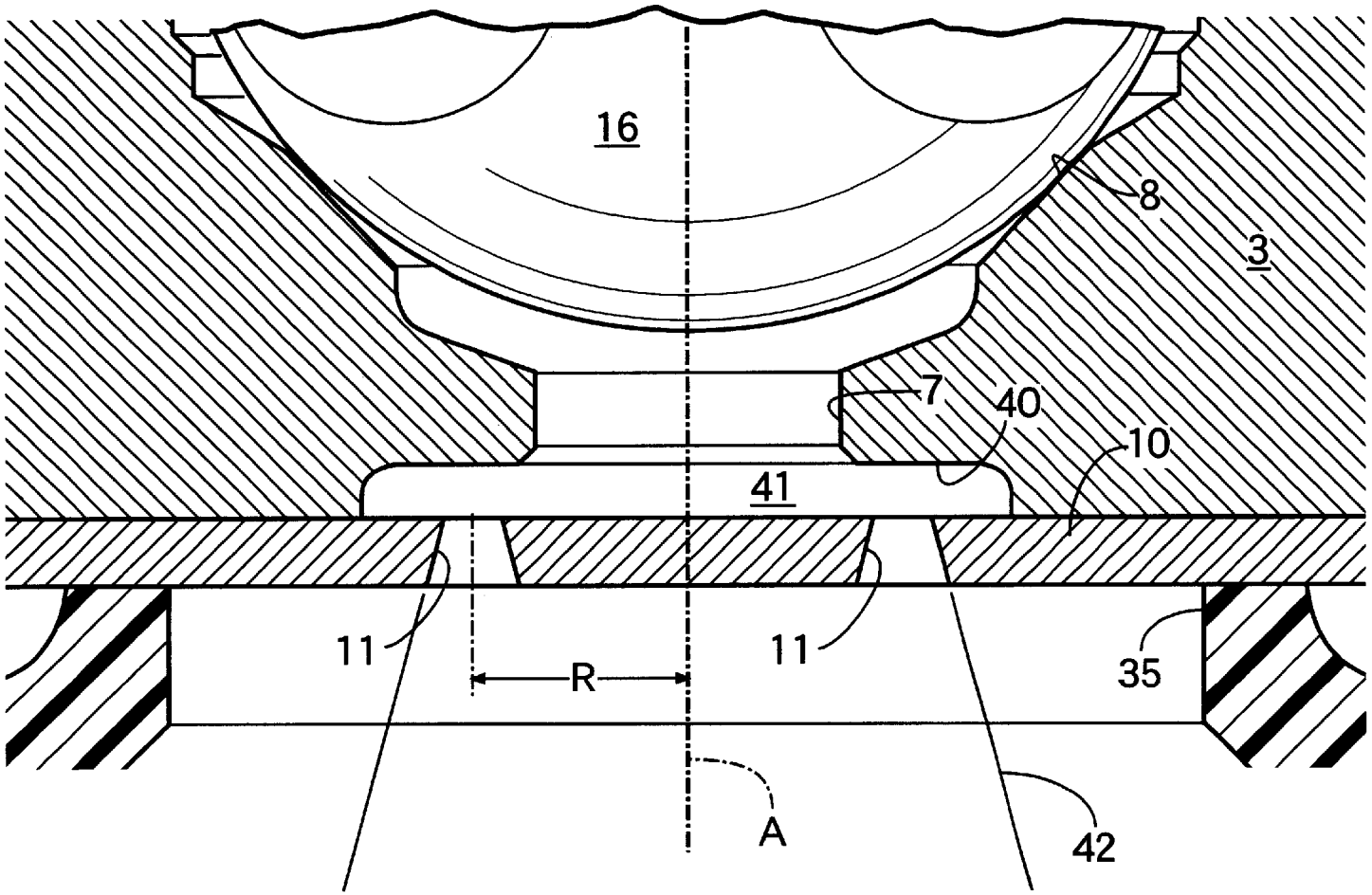
FIG. 6 is a sectional view similar to FIG. 4, showing a modification of a fuel injection bore.

As shown in FIG. 6, each of the fuel injection bores 11 may be formed into a frustoconical shape with its diameter increased toward a downstream side. Such shape ensures that the atomization of the fuel injected from each of the fuel injection bores 11 can be further promoted.

Although the embodiments of the present invention have been described in detail, it will be understood that the present invention is not limited to the above-described embodiment, and various modifications in design may be made without departing from the spirit and scope of the invention defined in claims.

What is claimed is:

1. A solenoid-type fuel injection valve comprising a valve seat member having a valve seat and a valve bore provided through a central portion of said valve seat, a valve stem for opening and closing said valve bore by cooperation with said valve seat, an injector plate coupled to an outer end face of said valve seat member and having a plurality of fuel injection bores disposed around an axis of said valve bore, and a fuel diffusion chamber which is defined between said valve seat member and said injector plate and which is faced by said valve bore and all of said fuel injection bores, wherein said plurality of fuel injection bores are formed in parallel and annularly around the axis of said valve bore at equal intervals between said fuel injection bores, and the spreading angle of a single fuel spray foam formed by the fuel injected from said fuel injection bores is determined depending on an axis distance between said valve bore and each of said fuel injection bores.

2. A fuel injection valve according to claim 1, wherein a relationship between the thickness t of said injector plate and the diameter d of each of said fuel injection bores is set at $t/d<1$.

3. A fuel injection valve according to claim 1 or 2, wherein each of said fuel injection bores is formed into a frustoconical shape with its diameter increased toward its downstream side.

* * * * *